US005378891A

United States Patent [19]

March et al.

[11] Patent Number: 5,378,891

[45] Date of Patent: Jan. 3, 1995

[54] METHOD FOR SELECTIVE COLLISIONAL DISSOCIATION USING BORDER EFFECT EXCITATION WITH PRIOR COOLING TIME CONTROL

[75] Inventors: Raymond E. March; Frank A. Londry, both of Ontario, Canada; Silvia Catinella, Padova, Italy

[73] Assignee: Varian Associates, Inc., Del.

[21] Appl. No.: 68,484

[22] Filed: May 27, 1993

[51] Int. Cl.[6] ..... H01J 49/42

[52] U.S. Cl. ..... 250/282; 250/292

[58] Field of Search ..... 250/282, 292, 291, 290

[56] References Cited

U.S. PATENT DOCUMENTS

| | | | |
|---|---|---|---|
| 4,540,884 | 9/1985 | Stafford et al. | 250/282 |
| 4,975,577 | 12/1990 | Franzen et al. | 250/282 |
| 5,298,746 | 3/1994 | Franzen et al. | 250/282 |

OTHER PUBLICATIONS

Ardanaz et al., *Rapid Communications in Mass Spectrometry*, vol. 5, No. 1, 1991, pp. 5–10.

Lammert et al., *J. Am. Soc. Mass Spectrom.* 1991, 2, 487–491.

*Primary Examiner*—Jack I. Berman

*Attorney, Agent, or Firm*—Edward H. Berkowitz

[57] ABSTRACT

A variable cooling time is imposed on ions in a quadrupole ion trap prior to excitation through border effect operation. Continuous variation of the cooling time brings about continuous variation of the selected ion internal energy when subjected to the boundary effect such that the boundary effect competes more favorably with ion loss in the trap, and fragmentation reaction channels having successively greater energies of activation can be accessed preferentially.

5 Claims, 8 Drawing Sheets

P=1.0 X 10⁻⁵ TORR
m/z 212
m/z 198
COOL TIME
110.00
100.00
90.00
80.00
70.00
60.00
50.00
40.00
30.00
20.00
10.00
0.00
0
10
20
30
40
50
60
70

METHOD FOR SELECTIVE COLLISIONAL DISSOCIATION USING BORDER EFFECT EXCITATION WITH PRIOR COOLING TIME CONTROL

FIELD OF THE INVENTION

The present invention is in the field of quadrupole ion traps and mass spectroscopy, and in particular relates to operation of quadrupole ion traps using border effect excitation.

BACKGROUND OF THE INVENTION

Tandem mass spectroscopy is commonly practiced in a quadrupole ion trap by the simple expedient of maintaining a residual partial pressure of a buffer gas in the trap. Some selected ion species (the parent ion) is selectively stored in the trap. The translational kinetic energy of the parent ion is increased and collisions with the buffer gas restfit with some probability, in the dissociation of the parent ion in to various energetically allowed decay channels. A finger print of the parent ion is then evident in the mass spectral distribution of the products of the dissociation.

In the prior art, it is known to increase the translational kinetic energy of stored ions by a resonant process wherein a supplemental AC field is imposed axially on the trap to transfer energy to the stored ions. Also a DC pulse of sufficient amplitude can cause stored ions to collide with the inner surface of the trap. The collision products are then available for further manipulation. This is described by Cooks et al, *J. American Society for Mass Spectroscopy,* V. 2, P. 487 (1992). It is known that certain operating conditions of the trap which approach a condition of instability will result in a large non-resonant energy transfer to the trapped ions. This "border effect" has been recognized and described by Paraclisi et al, *Organic Mass Spectrometry,* v. 27, PP. 251–254 (1992).

The present work makes use of the border effect with the additional recognition that through a period of selected duration prior to border effect operation, particular collisional dissociation channels may be emphasized or de-emphasized in accord with the length of the pre-border effect excitation interval which is referenced hereafter as the "cooling time".

Operation of a quadrupole ion trap to confine ions within the trap volume is a well known phenomenon. Associated with the quadrupole ion trap is a stability diagram (see FIG. 2) representative of a class of solutions of the equations of motion associated with the trap geometry. The theory, operation and prior art for quadrupole ion traps are reviewed in the work *Quadrupole Storage Mass Spectrometry* by March and Hughes, Wiley Interscience (1989). A typical quadrupole ion trap exhibits cylindrical symmetry and comprises a ring electrode having radial geometry of a hyperboloid of one sheet. In the axial coordinate, a pair of end cap electrodes define a hyperboloid of two sheets. For basic radial and axial dimensions of $r_0$ and $z_0$ respectively, the stability of ion motion is thus referenced to a coordinate system $a_z$, $q_z$ under the transformation:

$$a_z = \frac{-16eU}{m(r_o^2 + 2z_o^2)\Omega^2}$$

-continued $$q_z = \frac{+8eV}{m(r_o^2 + 2z_o^2)\Omega^2}$$

where e is the change on an ion of mass m. U is the DC bias between the ring electrode and the end caps and V is the RF amplitude of angular frequency n applied to the ring. From the metric defined by coordinates $a_z$ and $q_z$ one can establish the regions of stable operation corresponding to solutions of the Mathieu equation. Such a stability diagram is shown in FIG. 2. The region of stability is defined to be the internal area bounded by the two pairs of curves $\beta_z=0$ and its opposite $\beta_z=1$, and $\beta_r=0$ and its opposite $\beta_r=1$. The mathematical significance of these borders is examined in the above March and Hughes reference. It is sufficient to recognize that stable solutions to the equations of motion exist within the regions of stability. Stability means that ion displacement does not increase without limit.

The boundaries of the stability diagram have physical significance. In a practical trap, stability is a dual condition of concurrent radial and axial stability. The line $\beta_z=1$ may be regarded as a separation point in axial stability between unstable trajectories for ions of relatively low m/e in the direction of increasing $q_z$ from trajectories of ions of relatively higher m/e to the left of $\beta_z=1$. Thus, for points characterized by a selected m/e lying close to $\beta_z=1$, ions of lower value m/e ions will not be trapped. In like manner, for ions of selected m/e the line $\beta_z=0$ marks a region for transition to instability for ions having a higher value for m/e outside the boundary (in the direction of lower $q_z$). Similar significance attaches to the borders of radial stability $\beta_r=0$ and $\beta_r=1$. Selected ion species can be isolated in a two step process by translating the operating point of an ion species to the neighborhood of one boundary (or intersecting boundaries) to remove ion species of higher valued m/e and then to change the operating point to the proximity of the opposite boundary (or intersection) to remove ions of relatively lower m/e. An example of this procedure in an MS/MS content may be found in Ardanez, et al, *Rapid Communication in Mass Spectrometry,* V. 5, p. 5 (1991). A particular locus of points on the stability diagram may be regarded as corresponding to some class of orbital motion of the ions. In particular, the neighborhood of the borders of the stability diagram represents a class of oscillatory trajectories for which the kinetic energies approach the height of a hypothetical potential well representing the stable binding of a particular ion in the ion trap. Operation in proximity to the border (for some particular m/e value) has the consequence of transferring energy from the effective trapping field to the trapped ion. The trajectories executed by trapped ions are indefinite for purposes of this discussion. It is only required that these trajectories exhibit stability. This liberal condition permits trajectories of considerable complexity with the result that the trapped particles acquire substantial energy derived from the trapping field. It is emphasized that this is a non-resonant process.

In a practical arrangement, a selected partial pressure of a buffer gas is maintained in the trap to serve as a source of target particles for collision with trapped ions. It is desired to fragment the trapped (parent) ions to obtain daughter ions by collisional dissociation. Operating at certain regions on the stability diagram so as to obtain the benefit of the border effect, energy is transferred from the RF trapping field to the desired ions in rather large quantities. A collision event in which a parent ion scatter from a buffer gas atom without dissociation may simply disturb the parent ion trajectory. If the trajectory remains stable, the parent ion will be available to undergo further events. The probability of the desired collisional dissociation remains constant but the likelihood for occurrence of the desired dissociation increases with the number of collisions. Inasmuch as the parent ion is by definition, stable, it will be necessary to supply energy to the colliding system sufficient to exceed the threshold for the dissociation reaction.

In order to compare the degree of excitation achieved via the border affect, collisional dissociation experiments were compared between the triple quadrupole apparatus and a quadrupole ion trap. It was found that a supplemental RF excitation yielding collisional dissociation data characteristic of 5 eV parent ions could be obtained without undesired ejection of parent ions from the trap. Using the border effect spectra characteristic of 10 eV parent ions could be achieved. Evidently the border effect excitation process partition the available kinetic energy more effectively between radial and axial oscillatory components.

Physically the cooling interval is understood as a period of time for transfer of energy and momentum from the trapped sample, or parent ions to the buffer gas. As a result, the distribution of trapped parent ions contracts in both geometric and momentum space as energy is transferred to the buffer gas. In this manner, the total population of the trap is preserved, providing a potentially higher magnitude signal where the content of the trap is eventually sampled. This more compact aggregation of trapped ions is subsequently subject to a change in trap conditions which causes the operating point to closely approach a stability boundary. The resulting energy transfer from the trapping field to the previously cooled parent ions results in a higher signal to noise ratio than would occur for trapping at the same operating point without cooling. Any disturbance, such as the ionization process, yields a highly disordered distribution of ion orbits including large amplitude oscillations. A transfer of energy to these particular ions at that time would result in geometric amplitudes exceeding trap dimensions with consequent loss of ions. If the cooling process is first employed, these losses will be avoided and the subsequent signal, depending upon the ions of interest, will be larger with a resulting improvement in the signal-to-noise ratio.

Without a cooling interval, excitation will cause ions having trajectories of relatively large amplitude oscillation (and typically higher kinetic: energy) to be lost by exceeding the trap dimensions.

Another significant aspect of the above behavior is that the average energy (average in some abstract sense) of the ions remaining in the trap will be higher after a cooling interval followed by an energy transfer process because from a statistical point of view the initially lower energy orbits are relatively less depleted by the result of large energy transfer from the trapping field (leading to losses of ions).

The above observations are clearly a matter of degree. Consequently, one achieves a proportional effect in the average energy characteristics of ion motion for a given operating point close to a stability boundary, depending upon the prior cooling time interval. Any procedure which may be interposed during the cooling time may also result in disturbance to the trapped ions in the sense of introducing high amplitude oscillations. In the abstract, such a procedure is benefitted generally by the prior cooling time. In particular, ion selection may be interposed during the cooling time.

DETAILED DESCRIPTION OF THE INVENTION

Figure 1:
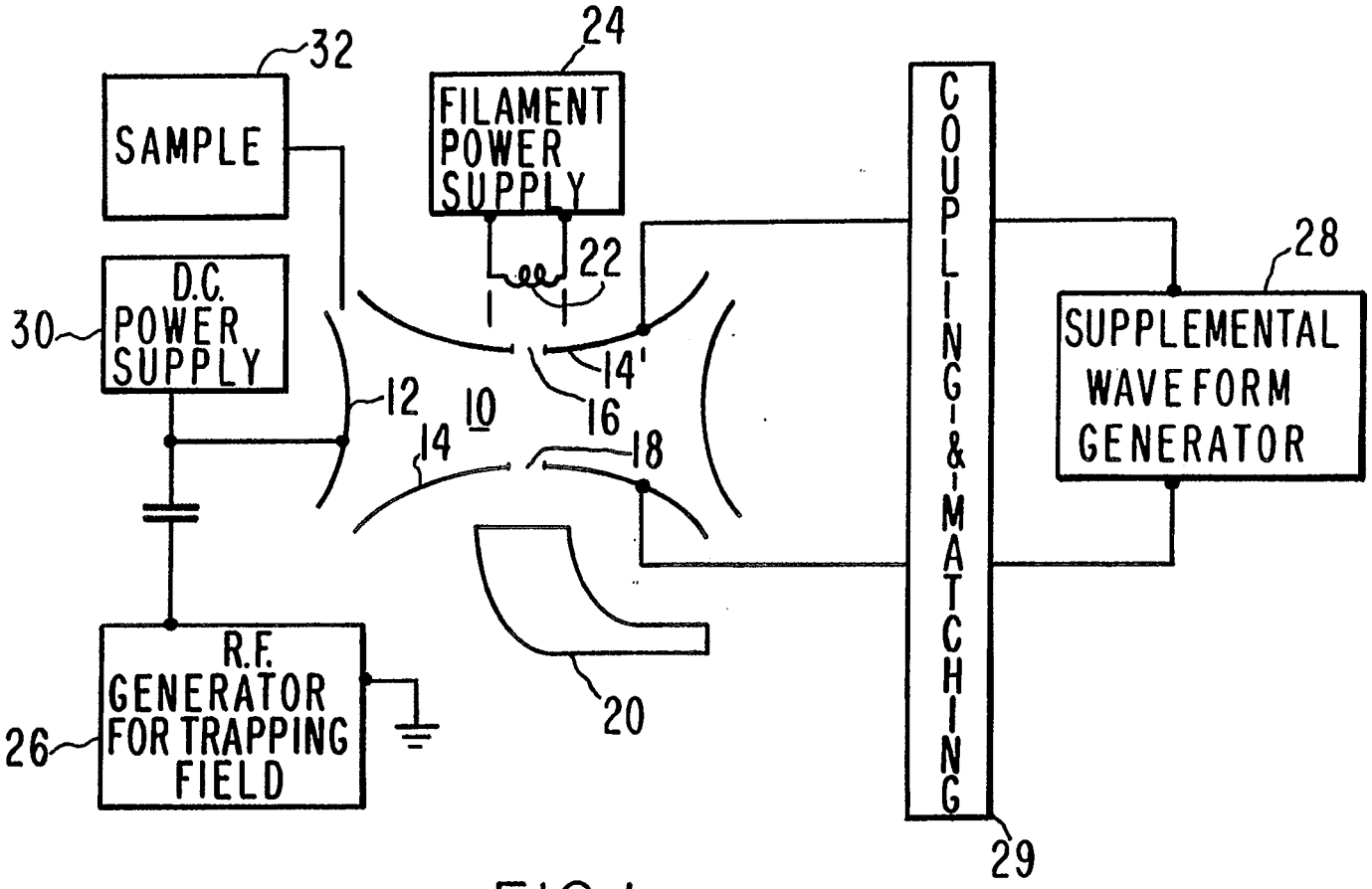
FIG. 1 is schematic illustration of a typical quadrupole ion trap apparatus suitable for the present invention.

Turning now to FIG. 1, a typical quadrupole ion trap includes a toroidal electrode 12, ideally having a surface contour of a hyperboloid. End caps 14 and 14', also ideally characterized by hyperbolic surfaces, are interrupted by apertures 16 to facilitate electron beam emission into the trap volume for ionization, and aperture(s) 18 for ejection of ions from the trap to detector 20. The electron beam ionization is effected with electron source 22 powered by power supply 24. RF generator 26 supplies the trapping field applied to the toroidal electrode 12 and supplemental wave form generator 28 is available when required, to supply axial modulation to the end caps via coupling and matching means 29. A DC potential is available from power supply 30 to bias toroidal electrode 12 with respect to ground. A sample is introduced to the trap 10 by sample introduction means 33.

Figure 3:
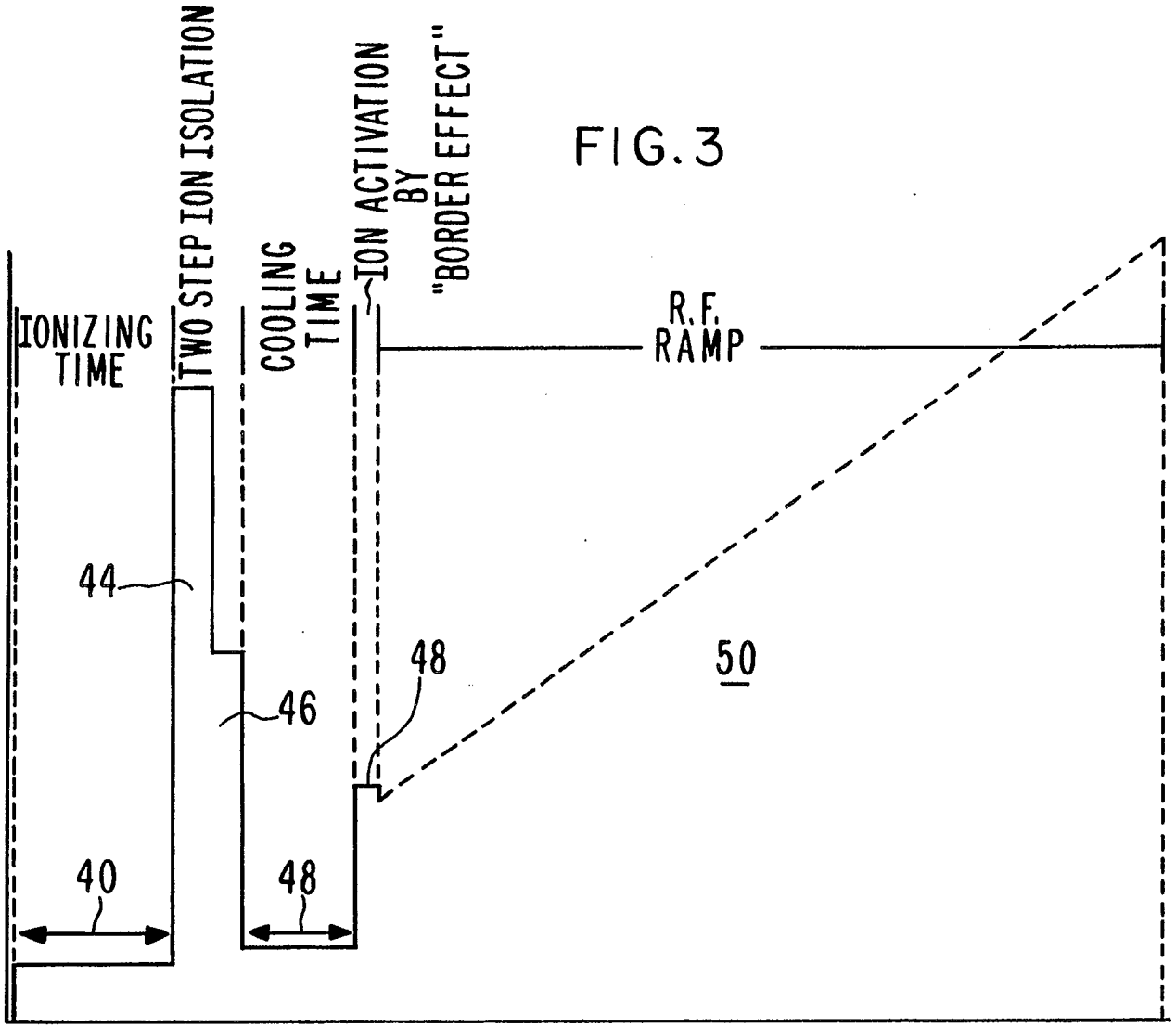
FIG. 3 shows an operational sequence for practicing the invention.
Figure 4:
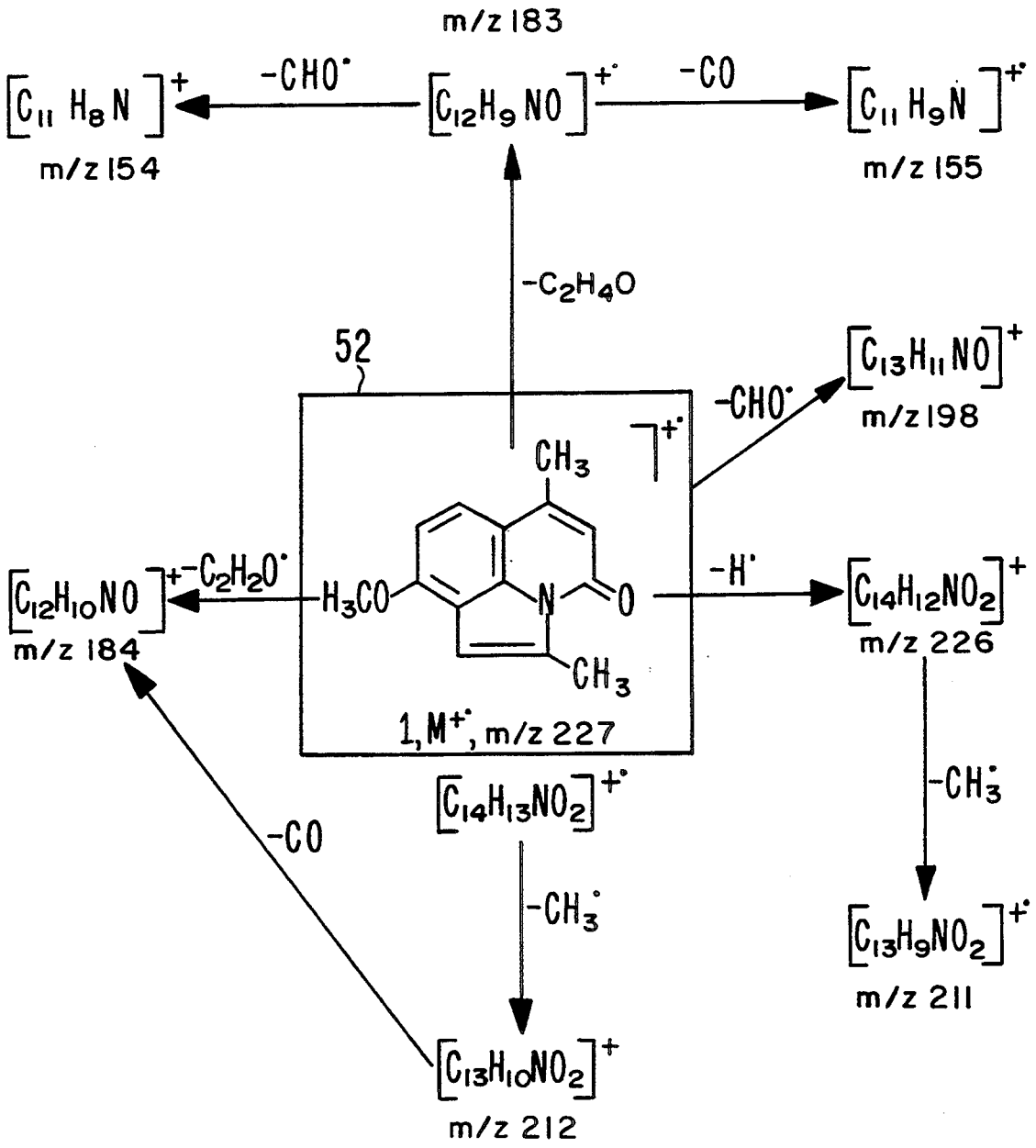
FIG. 4 describes dissociation modes of the particular sample (m/e 227) in relation to several observed masses.

A test of the present invention has been carried out to demonstrate the effect of selectable cooling time. An example operating sequence is shown in FIG. 3. By way of example, the ionization process 40 can be an electron impact process maintained over a duration sufficient for the purpose, such as 300 $\mu$s followed by isolation of the parent ion in a two step process 44 and 46 eliminating ions of m/e greater than 227 and less than 227. Cooling time 48 in accord with the present invention is selectively varied as discussed below. The DC bias is applied for 90 $\mu$s to bring the operating point on the stability diagram to close proximity with the $\beta_z=0$ boundary. The usual RF ramp is applied to scan the content of the trap to the detector 20. The only operating parameter which is varied is the cooling time. The experiments were repeated at four different buffer gas (He) pressures of $1\times10^{-5}$, $4\times10^{-5}$, $8\times10^{10-5}$, and $1.2\times10^{-4}$ torr. Turning now to FIG. 4, there is shown a relationship of the sample 2, 6 dimethyl-9methoxy-4h-pyrrole [3,2,1-ij]quinolin-4-one to a number of fragments and obtained through dissociation reactions indicated.

Each fragment is labeled by its respective mass-to-charge ratio. The experiments were designed to examine the relative behavior of the several decomposition channels as a function of the cooling time prior to displacing the trap operating point to proximity with the border $\beta_z=0$ for border effect excitation.

Figure 5:
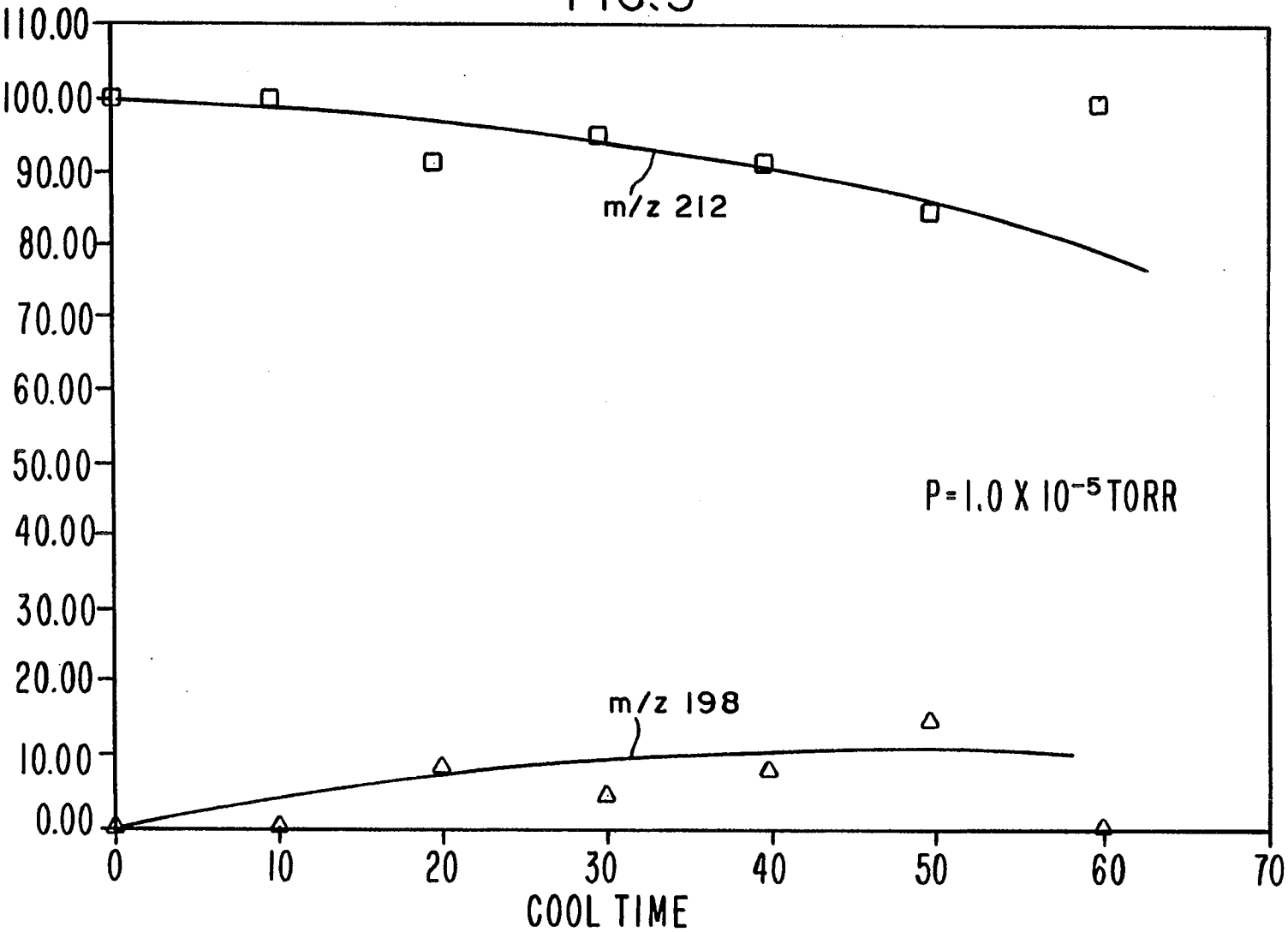
FIG. 5 shows the cooling time dependence for fragment masses observed at buffer gas pressure $1\times10^{-5}$ torr.
Figure 6:
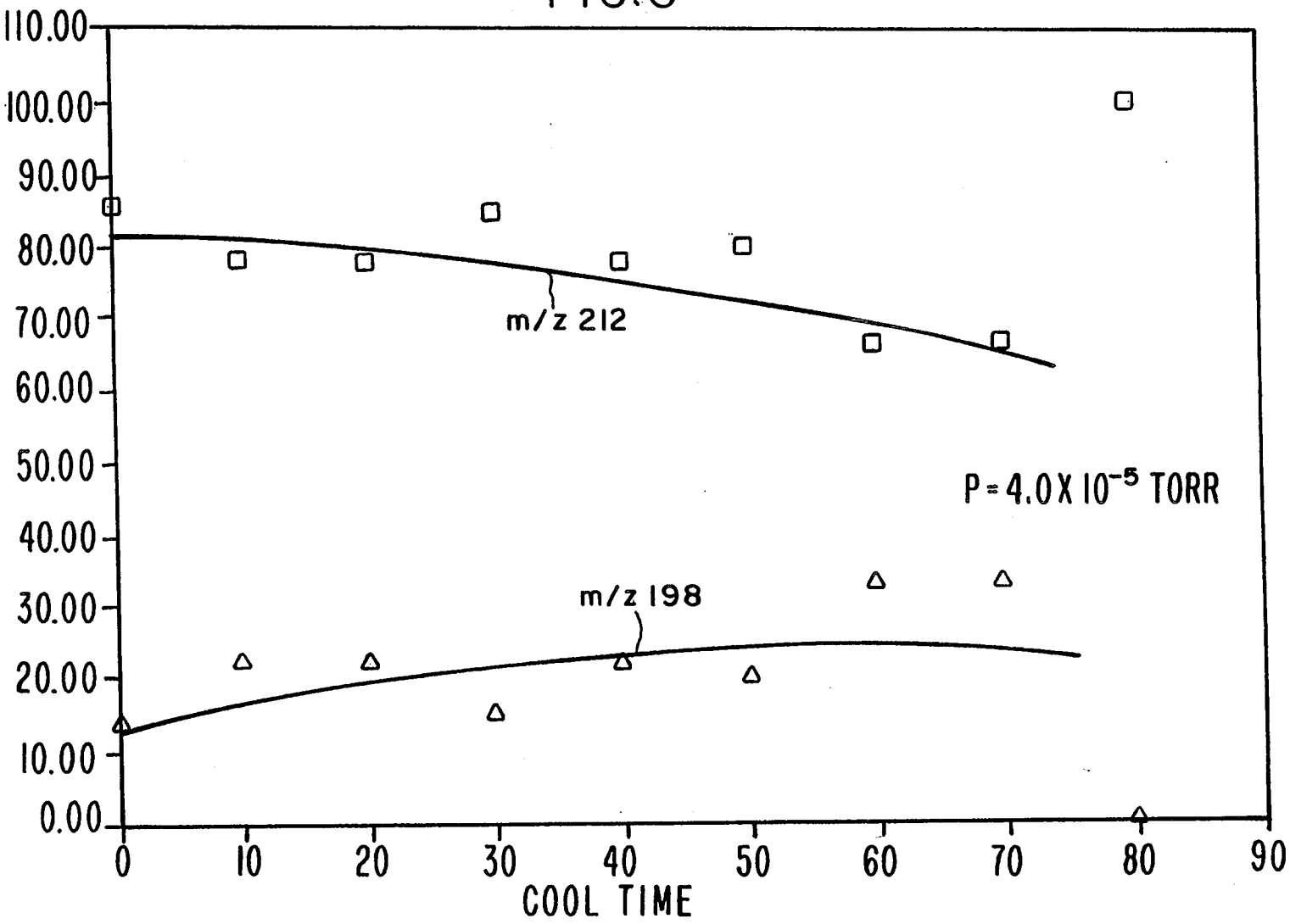
FIG. 6 shows the cooling time dependence for fragment masses observed at buffer gas pressure $4\times10^{-4}$ torr.
Figure 7:
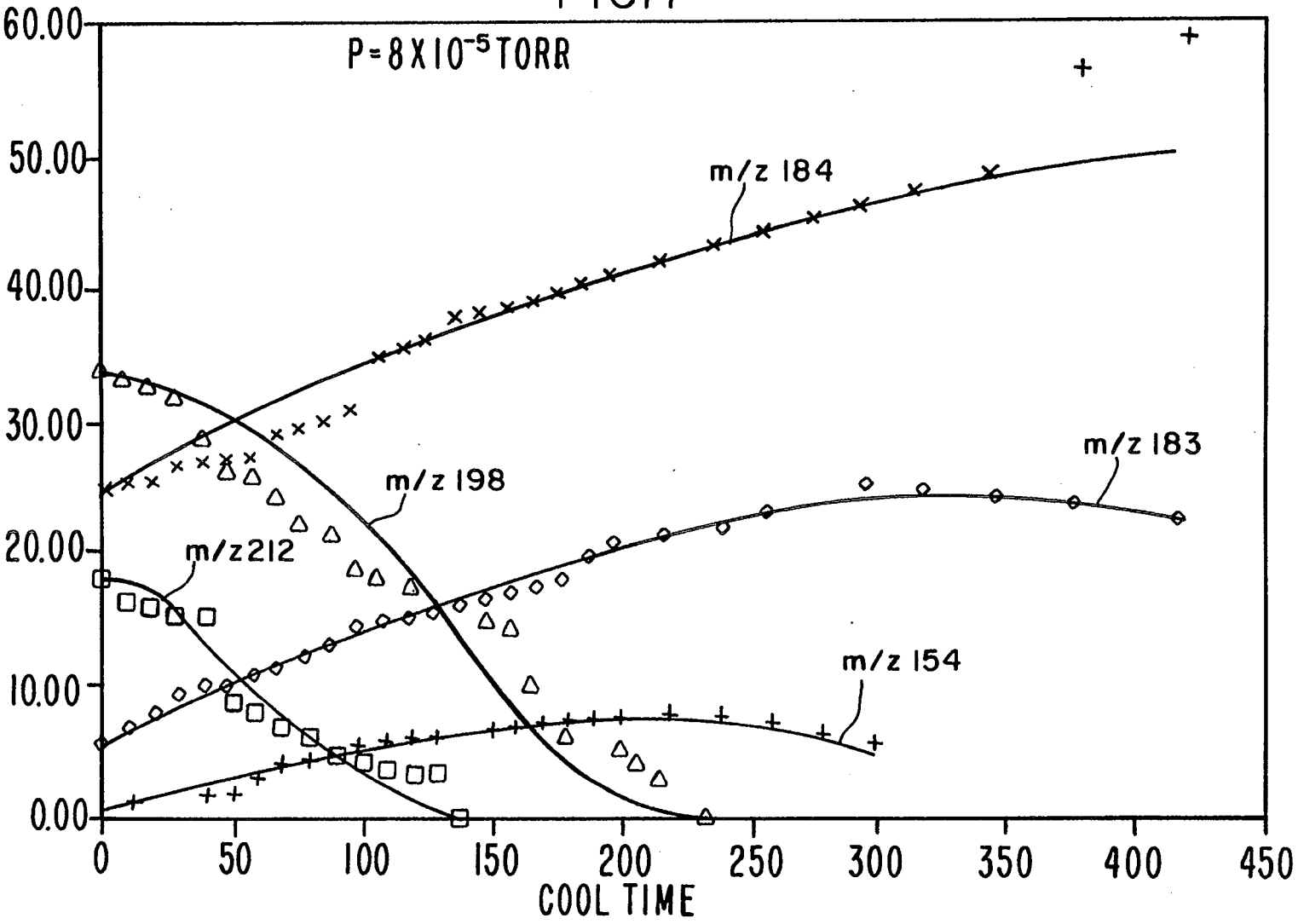
FIG. 7 shows the cooling time dependence for fragment masses observed at buffer gas pressure $8\times10^{-4}$ torr.
Figure 8:
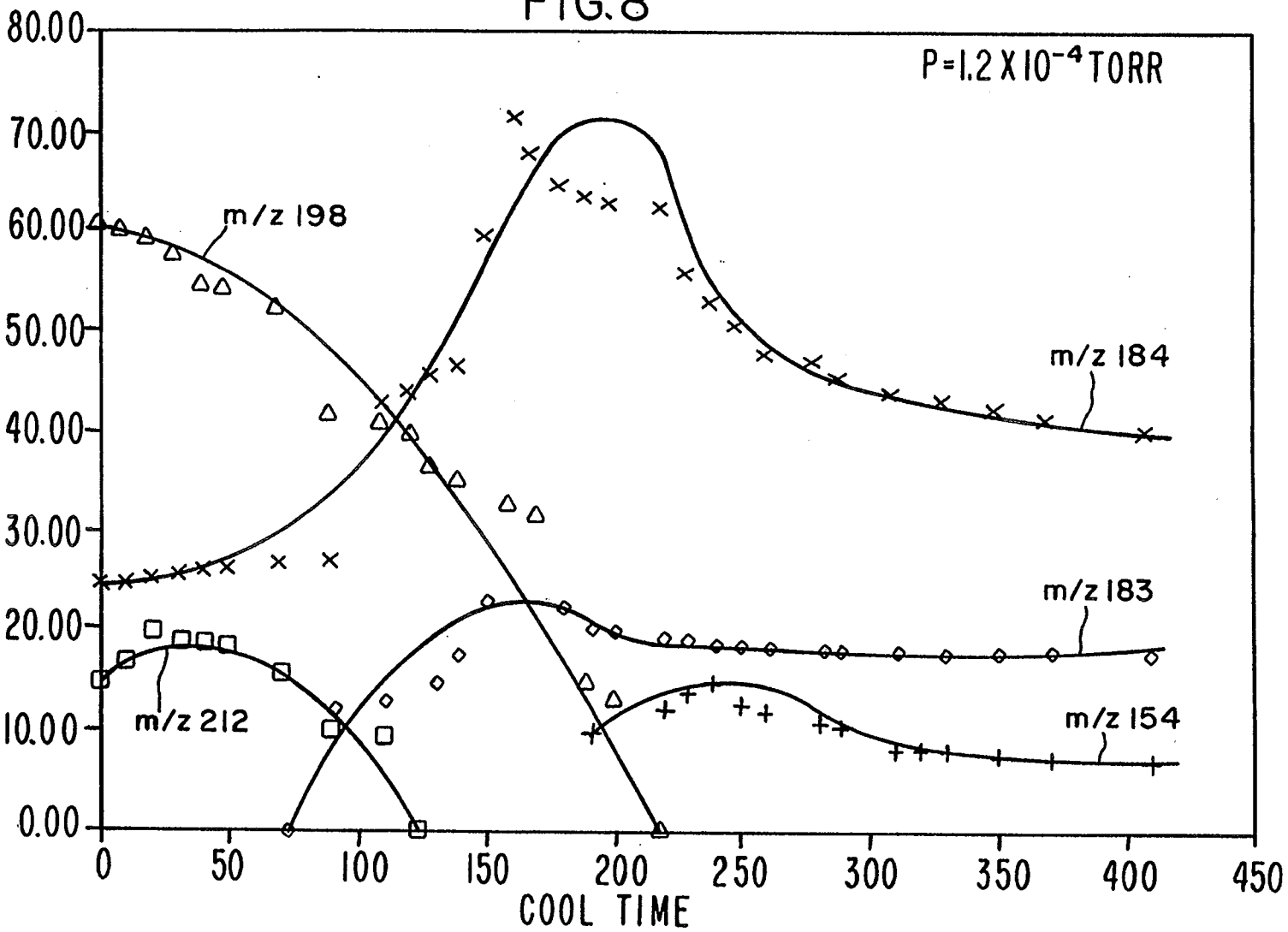
FIG. 8 shows the cooling time dependence for fragment masses observed at buffer gas pressure $1.2\times10^{-4}$ torr.

At the two lowest pressures, FIG. 5 and 6 respectively, only the dissociation channels based upon $CH_3$ and CHO loss are evident, leading to ions of m/e 212 and 198. The cooling time dependence is not pronounced or unusual. At the two higher pressures, many different fragment ions appear and the relative abundance of the several fragments exhibits striking dependence on the cooling time. The appearance of relative maxima in some of these data definitely suggests a particular collision dissociation channel is enhanced for a specific range of cooling time.

The data are consistent with the conjecture that the energy of the selected ion(s) is redistributed in response to the cooling time interval from a mostly axial translational degree of freedom to a combined distribution of axial, radial and internal degrees of freedom of the selected ion.

Figure 2:
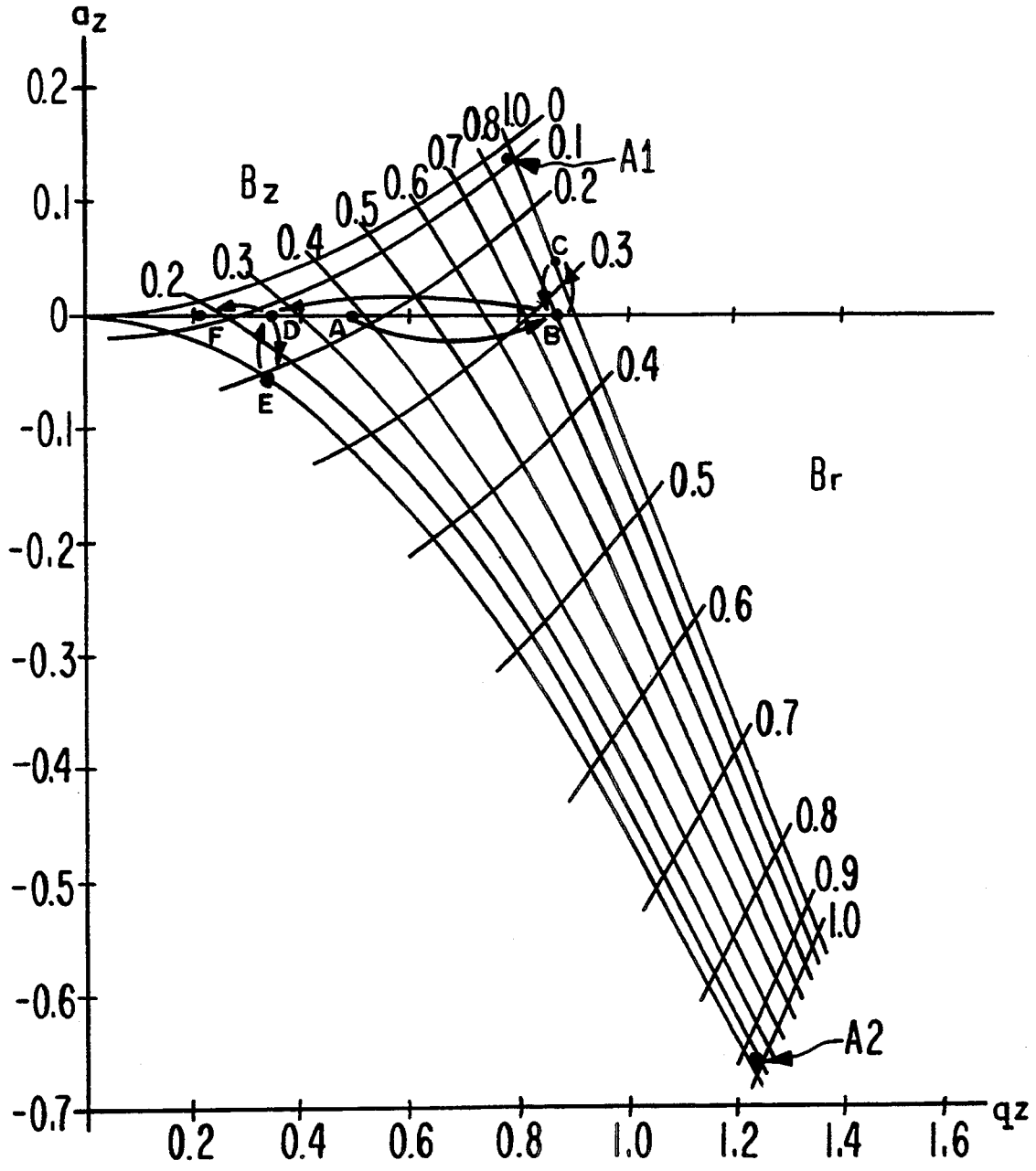
FIG. 2 is a quadrupole ion trap stability diagram.

A preferred manner of implementing the practice of the invention is shown on the stability diagram of FIG. 2. Following ionization of the sample, the selected ion species is to be found at point A. In order to achieve isolation of this value of m/e, the operating point is translated along the $q_z$ axis to a value in the vicinity of $q_z=0.84$ (point B) whereupon the operating point is moved upwardly, parallel to the $a_z$ axis to the vicinity of the locus of $\beta_z=1$ (point C). Trajectories of ions of lower mass-to-charge ratio become unstable and these ions are ejected. The working point is returned to point B and translated back along the $q_h$ axis to a point D from which the operating point is translated downwardly parallel to $-a_z$ until the neighborhood of $\beta_z=0$ is reached (point E). Trajectories of ions of higher m/z value become unstable and the ions are ejected from the ion trap. The most common trajectories of ions of higher mass-to-charge ratio become unstable and the ion of interest is now effectively isolated. The working point of the trap is now returned to point D and translated along $q_z$ to a point F located near the origin of the stability diagram. Here the system dwells for the selected cooling time. The operating point is then translated, in turn, along the $q_z$ axis to the vicinity of point D and either parallel to the $-a_z$ axis to the vicinity of the locus of $\beta_z=0$ (preferably) or parallel to the $a_z$ axis to the vicinity of the locus of $\beta_r=0$. Excitation of the selected ion via the border effect is then permitted to continue for a predetermined time interval.

Alternatively the two step ion isolation process may employ operating points at the apices A1 and A2 so as to create instability both radially and axially for mass-to-charge ratio respectively greater than, or less than that of the selected ion species.

The particular ion isolation procedure need not be limited to any particular technique. Other procedures for achieving a selected ion population in the quadrupole trap at various predetermined time intervals are known. The invention is not limited to any specific ion isolation or selection procedure.

Although the invention has been described herein in its preferred form, those skilled in the art will recognize that many variations and modifications may be made thereto without departing from the spirit and scope of the claim appended hereto.

What is claimed is:

1. The method of selectively fragmenting parent ions by collisional dissociation in a quadrupole ion trap comprising:
   (a) introducing a buffer gas to said quadrupole ion trap,
   (b) admitting sample gas for analysis to said quadrupole ion trap,
   (c) applying at least an RF field of amplitude V and a DC potential U to said quadrupole ion trap whereby to, trap ions of selected mass-to-charge ratio in a selected stable operational mode of said quadrupole ion trap,
   (d) ionizing said sample gas,
   (e) continuing said step of applying for a selectably variable time interval,
   (f) adjusting either said amplitude V or said potential U to assume values whereby said stable mode of operation is caused to closely approach a condition of instability whereby energy from said RF field is non-resonantly transferred to said selected ions and thence transferred from said selected ions to said buffer gas.

2. The method of claim I wherein step (e) further comprises the step of eliminating ions of mass-to-charge ratio outside a selected range during said selectively variable time interval.

3. The method of claim 1 wherein step d further includes the step of eliminating ions of mass-to-charge ratio outside a selected range.

4. The method of claim I wherein said step (d) includes introducing said sample gas to the quadrupole ion trap after ionizing said gas.

5. The method of claim 1 wherein step (c) further includes isolating a selected parent ion in said trap by ejecting selected ions from said trap.

* * * * *